United States Patent [19]

Huffman et al.

[11] Patent Number: 4,957,578

[45] Date of Patent: Sep. 18, 1990

[54] PROCESS FOR PRODUCING A PAPERBOARD PRODUCT FOR PREMIUM PACKAGING APPLICATIONS

[75] Inventors: Todd H. Huffman, Roanoke, Va.; Debora F. Massouda, Silver Spring, Md.; Thomas S. Williams, III, Covington, Va.

[73] Assignee: Westvaco Corporation, New York, N.Y.

[21] Appl. No.: 327,516

[22] Filed: Mar. 22, 1989

[51] Int. Cl.[5] ..... B29C 47/06

[52] U.S. Cl. ..... 156/244.11; 156/244.23; 428/204; 428/207; 428/412; 428/458; 428/475.5; 428/480

[58] Field of Search ..... 156/244.11, 244.23, 156/82; 428/204, 207, 412, 458, 475.5, 480

[56] References Cited

U.S. PATENT DOCUMENTS

| | | | |
|---|---|---|---|
| 3,629,037 | 12/1971 | Masuda et al. | 156/244.11 |
| 4,147,836 | 4/1979 | Middleton et al. | 428/48 |
| 4,343,858 | 8/1982 | Thompson | 428/342 |
| 4,432,820 | 2/1984 | Thompson | 156/82 |
| 4,455,184 | 6/1984 | Thompson | 156/244.11 |
| 4,543,280 | 9/1985 | Fujita et al. | 428/35 |
| 4,806,398 | 2/1989 | Martin | 156/244.11 |

*Primary Examiner*—Caleb Weston

[57] ABSTRACT

A process is disclosed for preparing a high quality paperboard product with high brightness and a defect-free glossy surface. The product comprises a structure consisting essentially of a paperboard substrate onto one surface of which there is first applied a coating of a pigmented polyolefin and a subsequent coating of a clear polymeric material such as a polyester. The brightness and loss achieved for the paperboard product is superior to conventional coated paperboard, cast coated paperboard, or other laminated paperboards currently in use.

6 Claims, No Drawings

PROCESS FOR PRODUCING A PAPERBOARD PRODUCT FOR PREMIUM PACKAGING APPLICATIONS

Background of Invention

The present invention relates to paperboard packaging material, and more particularly to a high quality paperboard product with high brightness and a defect-free glossy surface for premium packaging applications. The invention also relates to the method of making the improved product.

Paperboard which is coated with conventional aqueous coatings containing inorganic pigments such as clay, calcium carbonate and titanium dioxide is suitable for most packaging applications. However, for packaging high quality or premium products, manufacturers demand like quality in their packaging material. High brightness and gloss are two desireable characteristics of premium quality paperboard.

While the brightness of the pulp is the most important factor affecting the brightness of the finished paper or paperboard, the presence of pigments in the pulp or in coatings applied to the paper has a marked effect on the brightness of the paper. Meanwhile gloss may be described as the characteristic of the paper surface which causes the paper to reflect light at a given angle of reflection. Gloss is associated with high optical smoothness but does not necessarily go hand in hand with physical smoothness. The gloss of coated paper and paperboard is usually enhanced by the type of finishing steps performed on the surface of the paper or paperboard, or the method by which the coating is applied, for instance, by cast coating. However, a paperboard substrate that derives its brightness from the paperboard or coatings applied thereto, as for instance cast coated paperboard, looses the appearance of quality by turning yellow with exposure to light. This is particularly true when such products are printed with ultra-violet cured inks.

In the development of the paperboard product of the present invention, clay coated paperboard identified by the trademark PRINTKOTE owned by Westvaco Corporation was extrusion coated with various polymeric materials using an optical-finished chill roll. Various combinations of pigmented LDPE, pigmented polypropylene, pigmented PET and a combination comprising clear LDPE/pigmented PET were tried without success. In each case, the polymeric materials failed to enhance the brightness and gloss of the paperboard product, and in some cases even diminished those characteristics. For instance, PET diminished the brightness of the PRINTKOTE coated paperboard even when pigmented, and presented problems with adhesion to the coated paperboard surface. Nevertheless, a combination of paperboard/pigmented LDPE/clear PET was found to solve the problems with the other materials and produce a high quality product with enhanced brightness and gloss.

More recently, high quality paperboard has been manufactured for uses other than premium packaging applications with the use of extrusion coatings of polymeric materials. These products are aimed primarily at the market for paperboard trays and containers used in microwave ovens. Examples of these products are disclosed in U.S. Pat. No. 4,147,836- The production of PET coated paperboard with the use of a corona discharge treatment; U.S. Pat. No. 4,343,858- A pigment coated paperboard on which there is coextruded a top film of PET and an intermediate pigmented layer of an ester of acrylic acid, methacrylic acid or ethacrylic acid; U.S. Patent No. 4,432,820- A process for making a permanently bonded laminate comprising polyester and polyolefin layers; U.S. Patent No. 4,455,184- A process for lamination of PET to a paperboard substrate by coextruding a polyester layer and a polymeric adhesive layer onto a paperboard substrate; and U.S. Patent No. 4,543,280- A heat resistant ovenable paperboard comprising paperboard, an intermediate pigmented adhesive layer and a PET layer.

SUMMARY OF INVENTION

The present invention relates to a high quality paperboard product and the method for making it with high brightness and a defect-free glossy surface. The product produced by the present invention accepts both water and solvent based inks, is capable of being glued on conventional equipment, and has superior optical properties as compared with cast coated and clay coated paperboard.

In one embodiment of the present invention a structure comprising paperboard/pigmented LDPE/ clear PET solves all of the problems presented by the other combinations tried, and utilizes the best properties of each component. When a thin layer of PET is applied over a much brighter pigmented layer of LDPE, the final brightness of the product is enhanced, no adhesion problems are encountered, and the advantages of the PET surface layer are realized. The finished laminate has a minimum TAPPI brightness of 83 and a Hunter Gloss of greater than 100 at an angle of 60 degrees or more. The Hunter Gloss at 20 degrees is approximately 85. Because of the presence of the clear layer of PET over the pigmented LDPE layer, the surface takes on a liquid-like appearance, which is aesthetically superior to the appearance of a single, pigmented, glossy layer. The structure just described resists scratching and scuffing because of the polyester top surface. It resists yellowing because of the presence of the pigmented polyolefin layer. Moreover, the paperboard product of the present invention can be readily printed with ultraviolet cured inks without losing any brightness.

DETAILED DESCRIPTION

The paperboard product of the present invention is preferably prepared according to a process substantially as follows:

(1) The clay coated side of the paperboard substrate is primed and/or flame treatment to promote adhesion. A typical primer is a water solution of polyethyleneimine such as Adcote 313.

(2) The first extruder applies a pigmented polyethylene layer over the clay coating. This layer is approximately 1.5 mils thick and preferably contains 10–12% by weight of a pigment such as titanium dioxide. The extrusion step takes place against a matte-finished chill roll.

(3) The surface of the polyethylene coating is then flame treated to promote adhesion of the polyester coating. In the alternative, the surface may be corona discharge treated.

(4) The treated polyethylene surface is then extrusion coated with polyethylene terephthalate (PET). This layer is approximately 0.75 mils thick and is extruded against an optically-finished, high gloss chill roll.

(5) The PET surface is corona treated or flame treated so as to accept water based glue. There is no need to treat the PET surface for printing.

The finished product has a structure clay coated paperboard/pigmented LDPE/clear PET. The brightness and gloss of the finished product is in the range 83–85 TAPPI Brightness and in excess of 100 gloss units measured at an angle of 60 degrees. The same properties for a cast coated paperboard is on the order of about 84–86 TAPPI Brightness and 87–93 Hunter gloss at 75 degrees. The same measurements taken on conventional clay coated paperboard would be substantially lower, on the order of about 45–65 Hunter gloss at 75 degrees and 81–84 TAPPI Brightness.

The present invention may also be practiced with uncoated paperboard, but some coating improves the levelness of the paperboard surface. The priming step may not be needed if the paperboard is uncoated, or if the coating formulation is designed to promote adhesion with polyethylene (preferably LDPE).

In the preferred embodiment, the polyethylene layer is pigmented with titanium dioxide (10–12%) to achieve maximum brightness, but for less critical applications, some of the titanium dioxide could be replaced with other pigments, or the total pigment concentration could be reduced and still achieve a desireable TAPPI Brightness. It should also be understood that polyolefins other than LDPE could be used for the pigmented layer.

In addition, other polyesters such as glycol-modified or acid-modified polyethylene terephthalates, or polybutylene terephthalate could be used for the clear surface layer. Moreover, since there is a correlation between surface hardness and yield strength in polymers, other clear, extrusion coating polymers such as polycarbonates and nylons, with yield strengths comparable to that of PET would be expected to provide a satisfactory top surface.

In the preferred embodiment, a matte-finished chill roll is used for extruding the pigmented polyethylene layer. While any type of chill roll could be used, the mattefinished roll has been found to provide the best overall appearance. With the use of a smoother chill roll, more air becomes entrapped between the layers creating a less than attractive appearance which could lead to delamination.

Finally, the product of the present invention could be made by a coextrusion process in which case a tie layer would be required between the pigmented LDPE layer and the PET layer. An example of a typical tie layer would be one of the Bynel class of adhesives supplied by DuPont. The tie layer could be pigmented or unpigmented.

Although the invention has been described in considerable detail with reference to a particular preferred embodiment, it will be understood that modifications and variations of the invention are intended within the scope of the claims appended hereto.

What is claimed is:

1. A process for producing a paperboard product having a brightness of at least about 83 TAPPI Brightness and a Hunter gloss of 100-plus at an angle of 60 degrees suitable for use as a premium packaging material comprising the steps:

(a) applying a surface treatment to one surface of a paperboard substrate to improve its adhesion to a subsequent coating layer;

(b) passing the treated paperboard into a nip formed between a chill roll and a backup roll while simultaneously extruding onto the treated surface of the paperboard a polyolefin coating selected from the group consisting of polyethylene, low density polyethylene, linear low density polyethylene, and polypropylene containing a bright, white pigment;

(c) applying a surface treatment to the exposed surface of said polyolefin coating to improve its adhesion to a subsequent coating layer; and, (d) passing the treated and coated paperboard into a second nip formed between a chill roll and a backup roll while simultaneously extruding onto the treated surface of said pigmented polyolefin coating a clear coating of a polyester material selected from the group consisting of polyethylene terephthalate (PET), glycol-modified PET, acid-modified PEt, polybutylene terephthalate, polycarbonate and nylon to produce a defect-free, glossy surface.

2. The process of claim 1 wherein the chill roll in step (b) has a matte finish.

3. The process of claim 2 wherein the white pigment in step (b) is selected from the group consisting of titanium dioxide, calcium carbonate and clay.

4. The process of claim 3 wherein the amount of pigment included in the pigmented coating of step (b) ranges from about 1–12%.

5. The process of claim 4 which includes the additional step:

(e) applying a surface treatment to the exposed surface of said clear polyester coating to improve its glueability.

6. The process of claim 5 wherein the paperboard substrate comprises clay coated paperboard.

* * * * *